US005612096A

United States Patent [19]

Mulder et al.

[11] Patent Number: 5,612,096

[45] Date of Patent: Mar. 18, 1997

[54] METHODS AND APPARATUS FOR APPLYING POWDER TO WORKPIECES

[75] Inventors: Douglas C. Mulder, Wellington; Ronald E. Niemiec, Elyria, both of Ohio; Joseph Pintelon, Lennix, Belgium; Harald Pleuse, Langenfeld, Germany; Lawrence J. Macartney, Elyria, Ohio; Masafumi Matsunaga, Kanagawa, Japan; Don R. Scarbrough, Elyria, Ohio

[73] Assignee: Nordson Corporation, Westlake, Ohio

[21] Appl. No.: 428,026

[22] Filed: Apr. 25, 1995

Related U.S. Application Data

[62] Division of Ser. No. 906,677, Jun. 30, 1992, Pat. No. 5,474,609.

[51] Int. Cl.[6] ..... B05D 1/06; B05D 3/02; B05D 7/22

[52] U.S. Cl. ..... 427/466; 427/180; 427/181; 427/421; 427/477

[58] Field of Search ..... 427/180, 181, 427/195, 232, 234, 235, 236, 239, 421, 466, 476, 478, 475, 8, 477

[56] References Cited

U.S. PATENT DOCUMENTS

| | | | |
|---|---|---|---|
| 3,558,052 | 1/1971 | Dunn . | |
| 3,724,416 | 4/1973 | Diamond et al. | 118/7 |
| 3,746,254 | 7/1973 | Duncan et al. | 118/7 |
| 3,828,729 | 8/1974 | Goodridge | 118/634 |
| 3,870,375 | 3/1975 | Duncan et al. | 302/42 |
| 3,901,184 | 8/1975 | Payne et al. | 118/629 |
| 3,904,930 | 9/1975 | Waldron et al. | 317/3 |
| 3,918,401 | 11/1975 | Blakeslee | 118/630 |
| 4,025,664 | 5/1977 | Gerek et al. | 427/181 |
| 4,138,161 | 2/1979 | Payne | 427/28 |
| 4,158,071 | 6/1979 | Jordan et al. | 427/33 |
| 4,165,134 | 8/1979 | Payne | 406/1 |
| 4,180,844 | 12/1979 | Peck | 361/266 |
| 4,248,379 | 2/1981 | Hollstein et al. | 239/1 |
| 4,291,640 | 9/1981 | Payne et al. | 118/50.1 |

(List continued on next page.)

FOREIGN PATENT DOCUMENTS

| | | |
|---|---|---|
| 1497558 | 1/1978 | United Kingdom . |
| 2003754 | 3/1979 | United Kingdom . |

OTHER PUBLICATIONS

Japanese Unexamined Patent Application Kokai No. 60752, Mar. 1991—ABS Only.

Nordson Technical Publication 32–7–1, May 1983.

H.L.Fisher Manufacturing Company, Inc. Training and Service Manual for Model No. 107 Can and Post–Repair Spray Machine. No Date.

*Primary Examiner*—Shrive Beck
*Assistant Examiner*—Fred J. Parker
*Attorney, Agent, or Firm*—Tarolli, Sundheim, Covell, Tummino & Szabo

[57] ABSTRACT

An apparatus for spraying powder coating material includes a rotatable turret which moves articles to and from a work station. A powder spray gun is operable to spray a pattern onto each of the articles in turn while the article is at the work station. The powder flows through the spray gun as a series of pulses. A diverter assembly is operable to divert a portion of each pulse of powder away from the nozzle to more sharply define the pulse. An excess powder collector draws a flow of powder away from the work station. A virgin powder container supplies powder to a powder collector container which supplies powder to a powder feed container which supplies powder to the spray gun. Sensors associated with the virgin, collector and feed containers ensure that a predetermined quantity of powder is maintained in each container. During transport of powder from the virgin and collector containers, the containers and their associated pumps are vibrated to facilitate the flow of powder. The powder spray gun is mounted on a three axis adjustment assembly to enable the powder spray gun nozzle to be accurately positioned relative to an article at the work station.

21 Claims, 7 Drawing Sheets

U.S. PATENT DOCUMENTS

| | | | |
|---|---|---|---|
| 4,314,669 | 2/1982 | Moos | 239/1 |
| 4,399,945 | 8/1983 | Rund | 239/697 |
| 4,409,009 | 10/1983 | Lissy | 55/302 |
| 4,662,309 | 5/1987 | Mulder | 118/312 |
| 4,675,203 | 6/1987 | Scarbrough | 427/27 |
| 4,770,118 | 9/1988 | Vohringer et al. | 118/312 |
| 4,987,001 | 1/1991 | Knobbe et al. | 427/28 |
| 5,018,910 | 5/1991 | Weiss | 406/144 |
| 5,254,164 | 10/1993 | Masahumi | 118/58 |

METHODS AND APPARATUS FOR APPLYING POWDER TO WORKPIECES

This is a divisional of application Ser. No. 07/906,677, filed on Jun. 30, 1992, now U.S. Pat. No. 5,474,609.

BACKGROUND OF THE INVENTION

The present invention relates to improved methods and apparatus for applying powder to workpieces. The methods and apparatus may be utilized to apply powder to many different types of workpieces. However, it is believed that the methods and apparatus may be particularly advantageous when utilized to apply powder coatings to can interiors and can lids. Powder coating materials for coating containers are more in demand now than in the past due to increasingly more stringent government regulations on solvent emissions which are associated with liquid coating materials conventionally used in coating containers. Powder coating materials produce zero solvent emissions.

A known apparatus for applying powder to workpieces is disclosed in U.S. Pat. No. 4,987,001 issued Jan. 22, 1991 and entitled "Method and Apparatus for Coating the Interior Surface of Hollow, Tubular Articles". The apparatus disclosed in this patent includes a spray gun which sprays electrostatically charged powder onto workpieces. A powder supply system is provided to supply powder to the spray gun.

Another apparatus for spraying powder onto workpieces is disclosed in an unexamined Japanese patent application having a Kokai Number of 60,752 published Mar. 15, 1991 and entitled "Electrostatic Spray Gun". The apparatus disclosed in this patent application engages the opening of a gasoline can with an inner wall element of a powder spray nozzle. An outer wall element of the powder spray nozzle is maintained in a spaced apart relationship with the gas can. A catch piece has an elastic body which seals against the gas can. Once the inner wall element of the nozzle and the elastic body on the catch piece have engaged the gas can, electrostatically charged powder is applied to the gas can in an annular band which extends around the opening.

SUMMARY OF THE INVENTION

The improved methods and apparatus of the present invention relate to the applying powder to workpieces. The apparatus advantageously includes a rotatable turret which moves each of the workpieces in turn to and from a work station. At the work station, powder is sprayed onto the workpieces by a powder spray gun having a body section through which a flow of air with powder entrained therein is conducted. The powder is sprayed through a nozzle, onto each of the workpieces in turn at a work station. At the beginning and/or end of a spraying operation, a diverter assembly may divert a flow of air and powder away from the nozzle. An excess powder collector assembly encloses the nozzle and induces a flow of excess powder away from the workpiece.

An improved method and system for supplying powder to the spray gun includes a plurality of containers to hold fresh powder and powder returned from the spray gun or excess powder collector. Sensors are advantageously associated with at least some of the containers to sense the quantity of powder in the containers. When the quantity of powder in one of the containers is less than a predetermined quantity, a pump establishes a flow of powder to the container. Vibrators may be provided to vibrate at least some of the containers of powder. The vibrators also vibrate pumps through which the powder is conducted.

In a preferred embodiment of the invention, the nozzle of the powder spray gun is accurately positioned relative to a workpiece by an adjustment assembly. The adjustment assembly is operable to move the nozzle along as many as three mutually perpendicular axes. Indicia is provided in association with each of the axes along which the nozzle of the powder spray gun can be adjusted in order to facilitate accurate positioning the powder spray gun relative to a workpiece to be powder coated at a work station.

BRIEF DESCRIPTION OF THE DRAWINGS

The foregoing and other features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
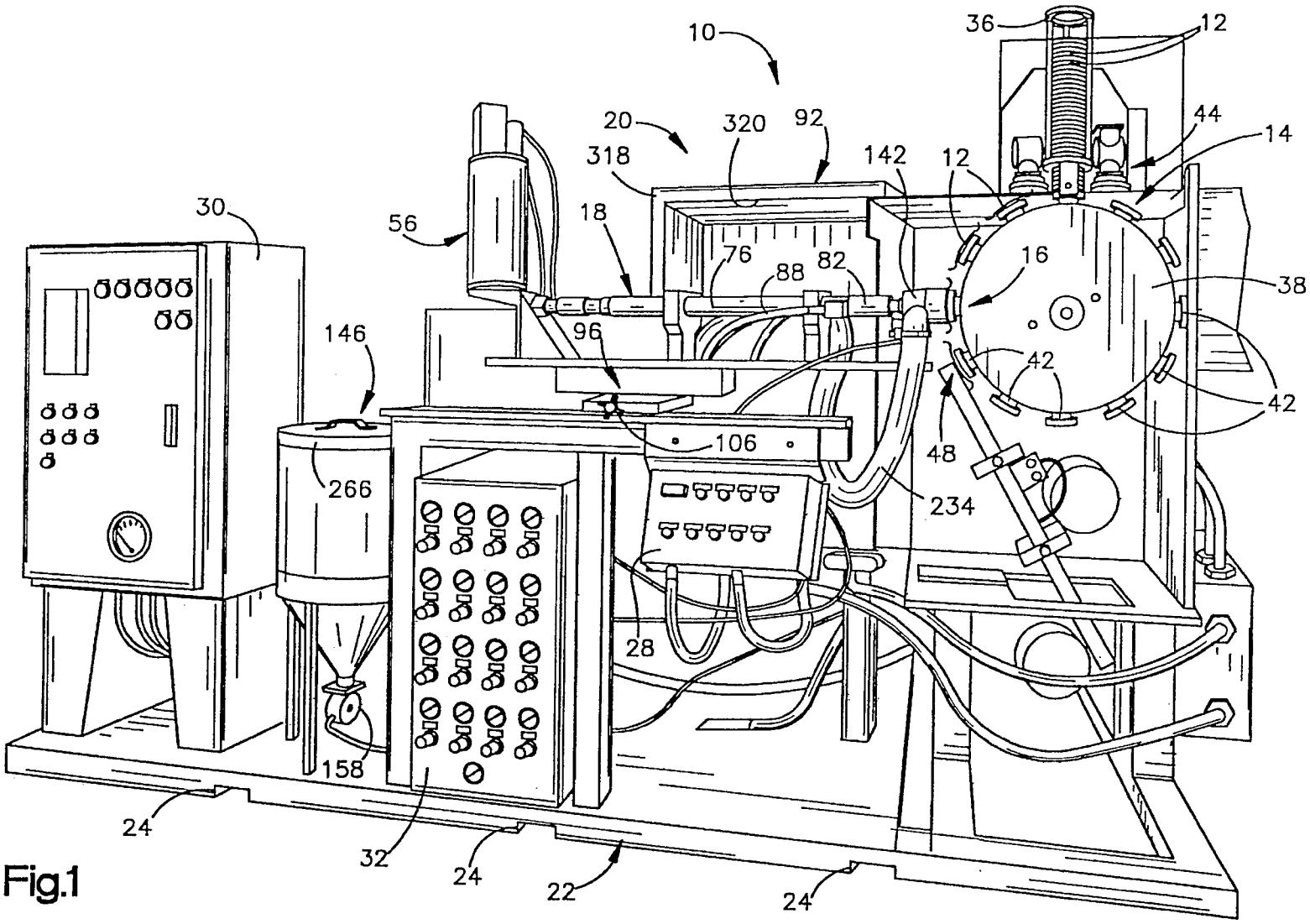
FIG. 1 is a simplified pictorial illustration of an apparatus constructed in accordance with the present invention to apply powder to workpieces.

An apparatus 10 (FIGS. 1 and 2) for sequentially applying powder to workpieces 12 includes a conveyor assembly 14 which sequentially moves the workpieces to a work station 16. A powder spray gun 18 is operable to spray powder onto each of the workpieces 12 in turn at the work station 16. A powder supply system 20 supplies powder to the spray gun 18. The conveyor 14, powder spray gun 18 and powder supply system 20 are disposed on a rigid platform 22 (FIG. 1) having surfaces 24 which are engageable to move the apparatus 10 between various locations.

The apparatus 10 includes an operator's control panel 28 (FIG. 1) which is positioned at an operator's station. A controller 30 includes electrical controls for the apparatus 10. A second controller 32 includes pneumatic controls for the apparatus 10. An air dryer (not shown) is mounted on the platform 22 adjacent to the controllers 30 and 32. The controllers 28, 30 and 32 are disposed on the platform 22 along with the conveyor 14, powder spray gun 18 and powder supply system 20.

It is contemplated that an apparatus 10 constructed in accordance with one or more of the features of the present invention may be utilized to apply powder to many different types of workpieces. However, the specific apparatus 10 illustrated in FIG. 1 has been designed for use in sequentially applying a powder coating to can lids. Thus, a stack holding assembly 36 is provided to sequentially supply can lids to the conveyor assembly 14.

The conveyor assembly 14 includes a circular turret 38. The turret 38 rotates in a counterclockwise direction, as viewed in FIG. 1, about a horizontal axis which extends perpendicular to and is in the same plane as a horizontal central axis of the spray gun 18. A plurality of workpiece holding chucks 42 extend radially outwardly from the turret 38 to grip the can lids 12. The can lids 12 are held on the chucks 42 by suction which is applied to a side of the can lid opposite to a side which is to be coated.

As the turret 38 indexes, or rotates, each can lid 12 is gripped in turn by one of the chucks 42 at a pickup station 44 (FIG. 1). As the turret continues to index, it moves each can lid 12 in turn to the work station 16. As each can lid 12 is indexed to the work station 16, rotation of the turret 38 is momentarily interrupted.

Figure 2:
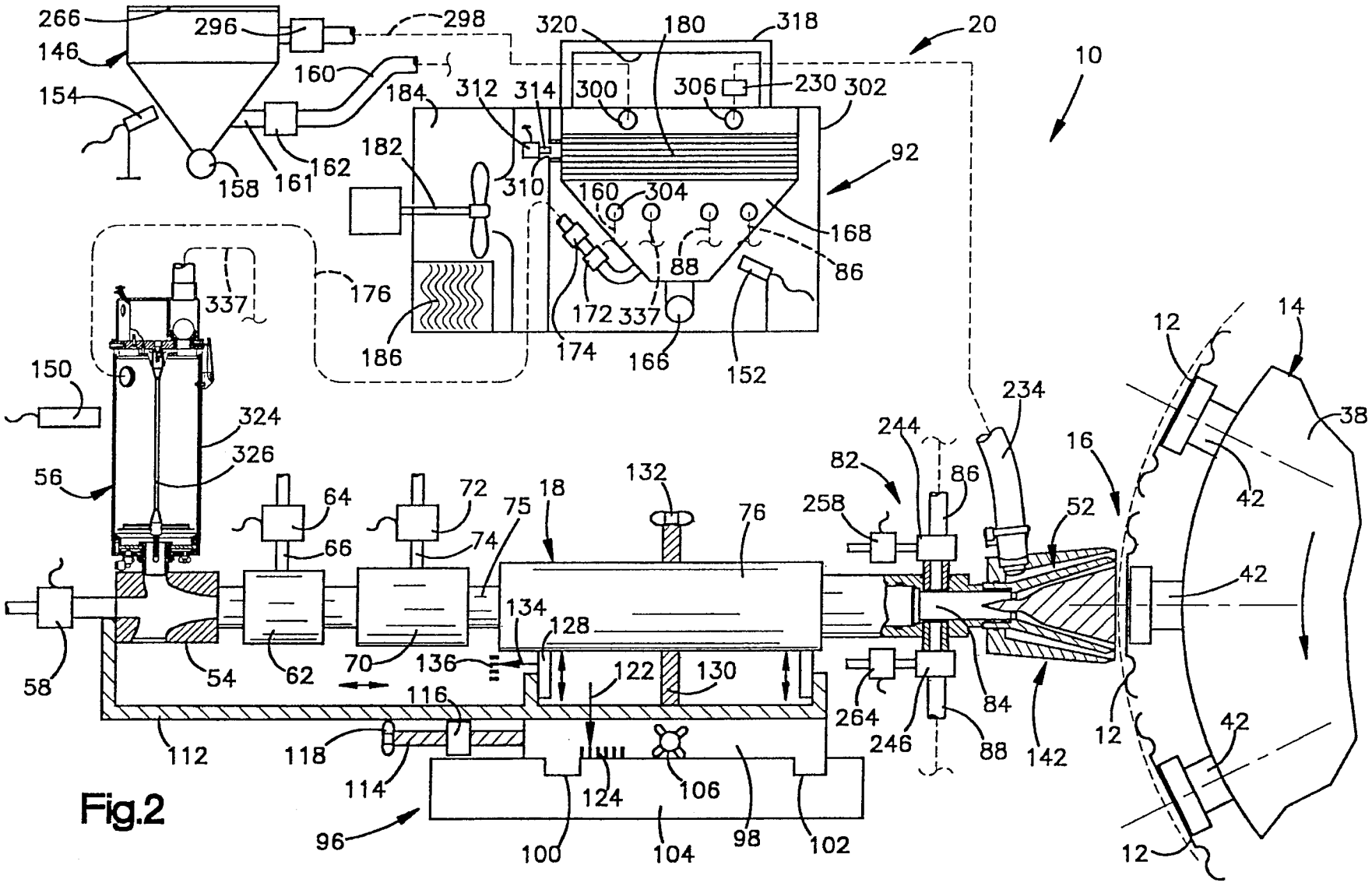
FIG. 2 is a schematic illustration of the apparatus of FIG. 1 and depicting the relationship between a conveyor turret, a powder spray gun and a powder supply system.

The spray gun 18 is then operated to spray powder onto the surface of a can lid 12. Although the powder could be applied to the can lid 12 in any desired pattern, the powder is applied in an annular band 46 (FIG. 3) to cover the circular score line 48 on an easy open can lid 12. The powder is applied to the can lid surface which faces outwardly toward the spray gun 18 (FIGS. 1 and 2). Indexing of the turret is then continued to move the next succeeding can lid to the work station 16.

The can lids 12 are sprayed at a very high rate. Thus, in one specific embodiment of the invention, approximately three hundred can lids 12 were sprayed during each minute of operation of the apparatus 10. Therefore, the spraying of the annular band 46 of powder onto each can lid 12 must occur during a relatively short period of time. In one specific embodiment of the invention, indexing of the turret 38 is stopped to hold a can lid stationary for a period of approximately one hundred and twenty-five milliseconds. An annular band 46 (FIG. 3) of powder is sprayed onto each can lid 12 in turn during operation of the spray gun 18 for sixty to ninety milliseconds.

Although the nozzle 52 has been specifically designed to apply an annular band 46 of powder to a can lid 12 at the work station 16, it is contemplated that the design of the nozzle 52 could be changed to apply powder in a pattern having a configuration other than annular and to a product other than a can lid. Thus, it is contemplated that the nozzle 52 could be designed to apply powder to the entire surface of the can lid 12 if desired. It should also be understood that the specific operating rates for the apparatus 10 have been set forth herein for purposes of clarity of description and not to limit the invention to any specific operating rate.

After the annular band 46 of powder has been sprayed onto the surface of a can lid 12, the can lid is moved to a discharge station 48 (FIG. 1) where the can lid is released from a chuck 42. As noted above, the can lid is held on the chuck 42 by suction which is applied to the can lid. At the discharge station 48, the application of suction to the surface of the can lid is interrupted to release the can lid for downward movement under the influence of gravity. Although many different types of indexing machines 38 could be used to convey the can lids 12, one satisfactory indexing machine is that used for a Model #107 Can End Post Repair Spray Machine, manufactured by H. L. Fisher Manufacturing Company, Inc. of Des Plaines, Ill., U.S.A.

The powder spray gun 18 has a nozzle 52 (FIG. 2) which sprays powder on a can lid 12 held by the turret 38 without engaging the can lid. Since the nozzle 52 does not engage a can lid 12 at the work station 16, the spray gun 18 can commence Spraying powder onto the can lid as soon as the can lid has been moved to the work station 16. This enables the can lid 12 to be moved to the work station 16, sprayed with powder by the spray gun 18, and moved away from the work station in a relatively short time.

In addition to the nozzle 52, the spray gun 18 has a venturi-type powder pump 54 (FIG. 2) which is connected with a powder feed container 56. Upon actuation of a solenoid valve 58 to an open condition, air is conducted through the venturi-type pump 54 and powder from the container 56 is entrained in the flow of air. An amplifier 62 is connected with the pump 54.

Upon operation of a solenoid valve 64, which is operated simultaneously with solenoid valve 58, air under pressure is conducted through a conduit 66 to the amplifier 62. This air is injected into the flow of air and powder conducted through the amplifier 62 from pump 54 to provide an additional pumping action. The flow of air with powder entrained therein moves from the amplifier 62 to a diffuser 70. Upon actuation of a solenoid valve 72 to an open condition, air under pressure is conducted through a conduit 74 to the diffuser 70.

From the diffuser 70, the flow of air with powder entrained therein enters an electrostatic charging unit 76. The electrostatic charging unit 76 is of the triboelectric type and includes a plurality of tortuously curved tubes which extend along the central axis of the powder spray gun 18. As the air and powder passes through these tubes, the powder frictionally contacts the walls of the tubes and picks up an electrostatic charge. The construction of the pump 54, amplifier 62, diffuser 70 and electrostatic charging unit 76 is the same as is described in the aforementioned U.S. Pat. No. 4,987,001 issued Jan. 22, 1991, which is hereby expressly incorporated herein, in its entirety, by this reference thereto.

A diverter assembly 82 (FIG. 2) is provided between the nozzle 52 and electrostatic charging unit 76. The diverter assembly 82 selectively interrupts the flow of powder to the nozzle 52 to sharply define the trailing end of the pulse or puff of powder to be applied to a can lid 12. When the diverter assembly 82 is in an active condition it diverts air or air and powder from a main passage 84 to conduits 86 and 88. The conduits 86 and 88 conduct the diverted powder to a powder collector container 92 in the powder supply system 20.

Against this background information on the operation of the system generally, each major component of the system will now be described in more detail.

Nozzle Positioning System

The nozzle 52 (FIG. 2) must be accurately positioned relative to the can lid 12 held on workpiece holding chucks 42 of turret 18 at work station 16. If the nozzle 52 is too close to a can lid 12, the can lid may impact against the nozzle during rotation of the turret 38. If the nozzle 52 is positioned too far away from the can lid 12 at the work station 16, on the other hand, the annular band 46 (FIG. 3) of powder will not be accurately applied to the can lid by the nozzle. In one specific embodiment of the invention, the nozzle 52 is spaced approximately ⅛ to 3/16 of an inch from the can lid 12 at the work station 16. Of course, the specific distance between can lid 12 and nozzle 52 will vary depending upon the diameter of the turret 38, geometry of nozzle 52, air pressure to the spray gun pump amplifier 62, and other factors.

In addition to providing for proper placement of the nozzle 52 the desired distance away from can lid 12 along the longitudinal central axis of the powder spray gun 18, it is also necessary to accurately position the nozzle so that it is concentrically located relative to can lid 12. For example, if the nozzle 52 is higher than it should be relative to the work station 16, a band 46 (FIG. 3) of powder applied to a can lid 12 will be offset upwardly relative to the center of the can lid. Similarly, if the nozzle 52 is offset horizontally relative to a can lid 12 at the work station 16, the annular band 46 of powder applied to the can lid will be offset horizontally relative to the can lid.

To provide for accurate positioning of the nozzle 52 relative to the can lid 12 at work station 16, therefore, a three-axis adjustment assembly 96 (FIG. 2) is provided. Thus, the adjustment assembly 96 is operable to position the nozzle 52 along X, Y and Z axes, where the X axis is considered to be the horizontal longitudinal central axis of the powder spray gun 18. The Y axis is considered to be a horizontal axis perpendicular to the X axis. The Z axis is considered to be a vertical axis which is perpendicular to the X and Y axes.

The adjustment assembly 96 includes a Y axis slide 98 (FIG. 2). The Y axis slide 98 is movable (into and out of the page in FIG. 2) along guide tracks 100 and 102 formed in a base 104. A knob 106 is connected with a lead screw to effect movement of the Y axis slide 98 along the guide tracks 100 and 102. An X axis slide 112, Z axis slide 128, powder spray gun 18, and the powder feed container 56 move along the Y axis with the Y axis slide 98.

The X axis slide 112 (FIG. 2) is mounted on the Y axis slide 98. An adjustment screw 114 engages threads in a nut 116 which is rigidly connected to X axis slide 112 and is rotatably journalled in the Y axis slide 98. Upon manual rotation of a knob 118, the X axis slide 112 is moved (to the left or right in FIG. 2) relative to Y axis slide 98. An indicator 122 connected to X axis slide 112 cooperates with indicia 124 on the Y axis slide 98 to indicate the position of the X axis slide 112 along Y axis slide 98 (i.e., along the X axis).

The Z axis slide 128 is in turn mounted on the X axis slide 112 and is movable vertically relative to the X axis slide. A lead screw 130 engages a nut (not shown) which is rigidly secured to Z axis slide 128 and which is journalled for rotation in X axis slide 112. Manual rotation of a knob 132 rotates the lead screw 130, to move Z axis slide 128 vertically relative to the Y axis slide 98 and X axis slide 112.

Electrostatic charging unit 76 of spray gun 18 is releasably clamped to Z axis slide 76 and moves with Z axis slide 76 as does diverter assembly 82 and nozzle 52. Upon movement of the Z axis slide relative to X axis slide 112, however, powder feed container 56, pump 54, amplifier 62 and diffuser 70 remain stationary. Flexing movement between electrostatic charging unit 76 and diffuser 70 as the Z axis slide 128 is moved is permitted by slip joint 75 which is a short cylindrical tube sealed by O-rings at each end. Of course, powder feed container 56, pump 54, amplifier 62 and diffuser 70 could be mounted on the Z axis slide 128 for movement therewith if desired.

An indicator 134 on Z axis slide 128 cooperates with indicia 136 carried on X axis slide 112 to indicate the vertical position of the Z axis slide. Although only indicia 124 and 136 for the X and Z axis slides 112 and 128 has been shown in FIG. 2, it should be understood that similar indicia cooperates with a pointer connected with Y axis slide 98 to indicate the position of Y axis slide 98 relative to the base 104.

It is contemplated that, from time-to-time, powder spray gun 18 will be disassembled for cleaning or routine maintenance. By providing suitable indicia to indicate the relative positions of the X, Y and Z axis slides, the powder spray gun can be reassembled and quickly moved back to the desired position relative to the lid 12 at work station 16 when the routine maintenance has been completed. Moreover, indicias for the X, Y and Z axis can be used during test runs to determine the optimal position of nozzle 52 relative to the workpiece being coated.

Powder Supply System

The powder supply system 20 (FIG. 2) controls the flow of powder to and from the powder spray gun 18. Powder supply system 20 supplies both virgin powder and recycled powder to the spray gun 18. Powder supply system 20 receives powder from diverter assembly 82 and an excess powder collector 142. The excess powder collector 142, later described in detail, draws excess powder which does not adhere to the can lid away from the work station 16 to the powder collector container 92 of supply system 20.

Powder supply system 20 is principally comprised of a bulk powder container 146 and a powder collector container 92, both of which components are described in more detail later on. Virgin powder is poured into bulk container 146 and is transported from container 146 to the powder collector container 92 as needed. In powder collector container 92, the virgin powder is mixed with the recycled powder which is returned to the powder collector container from the diverter assembly 82 and excess powder collector 142. This mixed powder is then transported from powder collector container 92, as needed, to the powder feed container 56 which is also later described in detail. Feed container 56 supplies powder to spray gun 18.

Supply system 20 maintains a predetermined minimum quantity of powder in powder feed container 56 and in the powder collector container 92. If the quantity of virgin powder in bulk powder container 146 falls below a minimum predetermined amount of powder, an audible or visual output signal is provided to the operator of the apparatus 10 indicating that container 146 needs to be manually refilled.

To enable powder supply system 20 to maintain a predetermined minimum quantity of powder in feed container 56, a sensor 150 (FIG. 2), later described, provides an output signal when less than a predetermined quantity of powder is in feed container 56. The output signal from the sensor 150 initiates the transport of powder from powder collector container 92 to feed container 56. Likewise, a sensor 152 senses the quantity of powder in the powder collector container 92. When sensor 152 senses that the quantity of powder in the powder collector container 92 is less than a predetermined quantity, an output signal from the sensor 152 initiates the transport of powder from bulk container 146 to collector container 92. Finally, a sensor 154 is provided to sense when the quantity of powder in the bulk container 146 is less than a predetermined quantity. When this occurs, an output signal from the sensor 154 initiates an audible and/or visual alarm to an operator indicating the need for manually refilling the container.

Bulk container 146 and the collector container 92 are vibrated when powder is to be fed from the containers. In addition, the powder transfer pumps associated with these containers are vibrated along with the containers 146 and 92. Vibrating the powder transfer pumps and containers minimizes any tendency for the powder feed path to clog. Vibration is a particularly useful method of transport for the types of powders used in container coating which are generally difficult to fluidize. It is also important that the powder be kept dry so that it won't clump together and this is accomplished by using an air dryer for all transport air used in the system.

A vibrator 158 (FIG. 2), manufactured by Vibco, Inc. of Wyoming, R.I., as Model VS-250, is operable to vibrate bulk powder container 146 when virgin powder is to be transported through a conduit 160 to powder collector container 92. A venturi-type powder feed pump 162, which is preferably a pump manufactured by Nordson Corporation of Amherst, Ohio, under Part No. 245,477, is connected to bulk container 146 by a relatively rigid conduit 161 to feed powder to the conduit 160. Pump 162 is vibrated with bulk container 146 by the vibrator 158. By vibrating both bulk container 146 and the pump 162, a flow of powder from bulk container 146 to pump 162 is promoted. In addition, vibrating the pump 162 promotes the flow of powder through the pump 162 to collector 92. Pump 162 and vibrator 158 are operated whenever the sensor 152 indicates that additional powder is required at the powder collector container 92. Bulk container 146 is mounted on platform 22 by means of vibration damping pads (not shown) so that the vibration of container 146 is not transferred to platform 22.

A vibrator 166 identical to vibrator 158 is operable to vibrate a hopper 168 of powder collector container 92 when powder is to be fed from collector container 92 to powder feed container 56. In addition to vibrating the hopper 168, operation of vibrator 166 vibrates a powder feed control valve 172, which is preferably a Series 2600 valve manufactured by Red Valve Co., Inc. of Carnegie, Pa., and a feed pump 174, which is identical to pump 162, during the feeding of powder from collector container 92 to feed container 56 through a conduit 176. The venturi-type powder feed pump 174 is continuously operated by compressed air from controller 32 so that the air pressure on the powder in-feed container 56 remains constant. Powder flow control valve 172 is opened to enable powder to flow from hopper 168 to pump 174 whenever sensor 150 indicates that additional powder is required at the powder feed container 56. Like bulk container 146, hopper 168 is mounted on platform 22 by means of vibration damping pads (not shown) so that the vibration of hopper 168 is not transferred to platform 22.

An initial filter 180 (FIG. 2) is provided above the hopper 168 of collector container 92. Initial filter 180 comprises a pair of hollow cylindrical filter cartridges which are horizontally mounted side-by-side above hopper 168. FIG. 2 shows a side view of one of the cartridges 180, with the other cartridge being directly behind the one shown. Each of the filter cartridges 180 is open at one axial end through an opening 310 to a continuously operating fan assembly 182. Fan assembly 182 continuously draws air through openings 310 (only one of which is shown in FIG. 2) and filters 180 from collector container 92. As the powder laden air from collector 92 flows into the cartridges 180, the powder collects on the cartridges' exterior and the cleaned air flows into the cartridges' interior. The fan assembly 182 draws this cleaned air from the open end of filter cartridges 180, through openings 310 and pressures a fan compartment 184 in the powder collector container 92.

To relieve this pressure, air continuously flows from the compartment 184 through a final filter 186 to the atmosphere around the apparatus 10. The final filter 186 removes any powder which may remain in the air after it has passed through the filters 180. The combination of the initial and final filters 180 and 186 eliminates the need to vent air through a stack to the atmosphere outside of a building containing the apparatus 10. Suitable monitors may be provided in association with the final filter 186 to indicate when the final filter should be cleaned. As will be explained later on in more detail, the powder which is collected on the exterior of cartridges 180 is periodically pulsed off to fall into collection hopper 168. This pulse cleaning mechanism is also described in U.S. Pat. No. 4,662,309 which is incorporated herein, in its entirety, by this reference thereto.

Powder Spray Nozzle

The powder spray nozzle 52 (FIGS. 3 and 4) is maintained in a spaced apart relationship with respect to the can lids 12 as they are sequentially moved to the work station 16 (FIG. 2), sprayed with powder at the work station (FIG. 3), and moved away from the work station. Although the can lid 12 and nozzle 52 do not engage each other at any time during the process, the nozzle is very close to the can lid when the can lid is at the work station 16. Thus, when the can lid 12 is at the work station 16, front surface 192 of can lid 12 is spaced approximately ⅛ to 3/16 of an inch from the nozzle 52.

Figure 3:
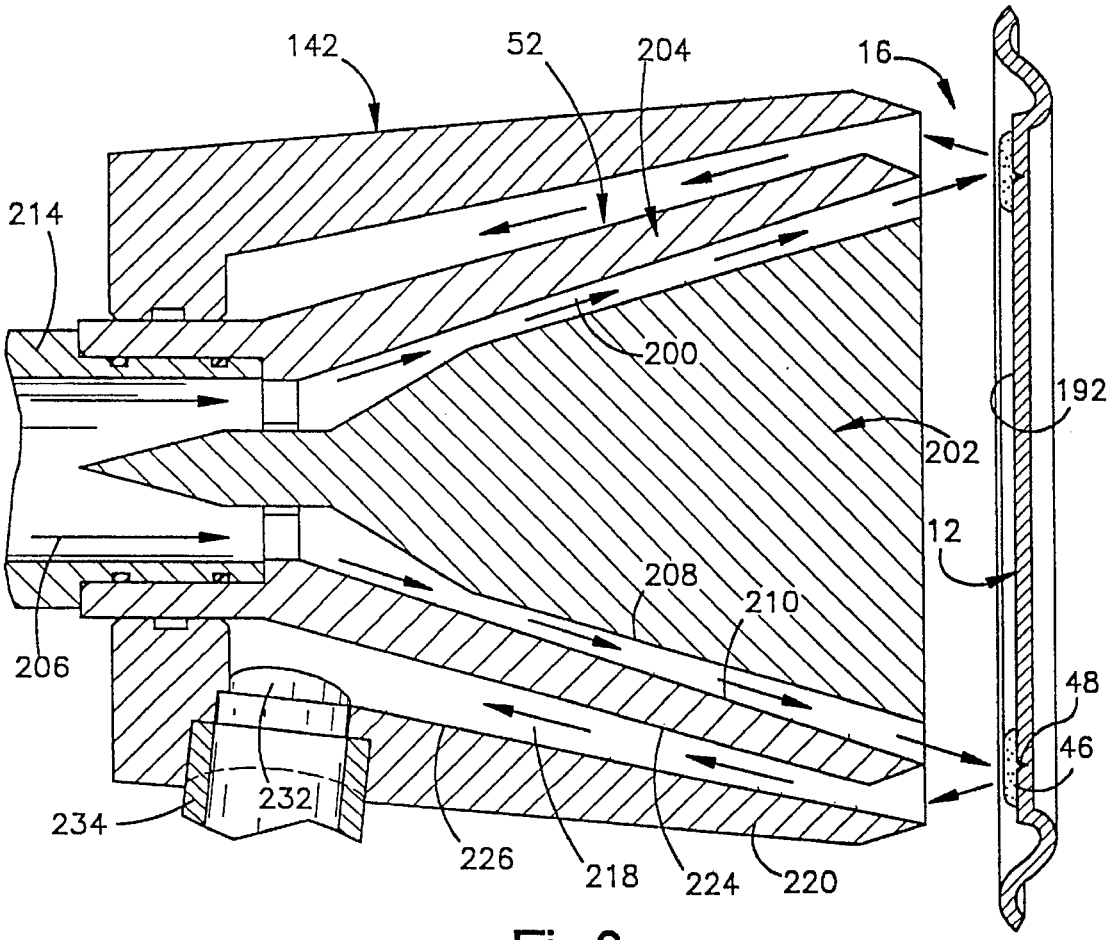
FIG. 3 is an enlarged schematic sectional view illustrating the relationship of a nozzle of the powder spray gun and an excess powder collector to a workpiece to which powder is being applied.

The nozzle 52 sprays powder onto the surface 192 (FIG. 3) of the can lid 12. The powder is deposited on the can lid in an annular band 46. Although the annular band 46 of powder could be disposed at many places on the can lid 12, the powder is shown in FIG. 3 as being deposited over a circular score line 196. After the can lid 12 has been moved away from the work station, the powder is heated and forms a protective coating over the score line 196.

Nozzle 52 includes a generally conical powder flow channel 200 through which air with powder entrained therein flows toward the can lid 12. Powder flow channel 200 is formed between an inner deflector cone 202 and an outer deflector cone 204. Inner deflector cone 202 engages the center of a stream 206 of air and powder as the stream enters nozzle 52.

When stream 206 (FIG. 3) of air and powder enters nozzle 52, stream 206 has a solid circular cross sectional configuration. Inner deflector cone 202 opens stream 206 as the air and powder flows around a conical outer side surface 208 of inner cone 202. As the stream 206 flows around cone 202, the cross sectional configuration of the stream becomes annular. As cone 202 flares radially outwardly and stream 206 moves toward can lid 12, cone 202 opens up the central portion of the stream to increase the inside diameter of the annular cross section of stream 206.

The outer deflector cone 204 cooperates with the inner cone 202 to limit the extent to which the inner cone 202 expands the annular cross sectional configuration of stream 206 of air and powder radially outwardly. Thus, a conical inner side surface 210 on outer cone 204 is evenly spaced from outer side surface 208 of inner cone 202. In one specific embodiment of the invention, outer surface 208 of cone 202 and inner surface 210 of cone 204 are spaced apart by a radial distance of approximately 0.1875 inches. The annular band 46 of powder deposited on the can lid 12 has approximately the same radial extent. Of course, the spacing between the surfaces of the inner and outer deflector cones 202 and 204 and the radial extent of the band 46 of powder may be different than the foregoing specific dimension if desired.

In one specific embodiment of the nozzle 52, inner deflector cone 202 had a maximum outside diameter, at the axially outer or rightward (as viewed in FIG. 3) end of the cone 202, of approximately 2.5 inches. This resulted in the annular band 46 of powder deposited on can lid 12 having an inside diameter of approximately 2.5 inches. Of course, the annular band 46 of powder could have a different diameter if desired.

A body section 214 of the powder spray gun 18 is telescopically inserted into the axially inner or left (as viewed in FIG. 4) end of outer deflector cone 204 of the nozzle 52. The nozzle 52 is in this way supported by the outer end portion of the body section 214.

In the illustrated embodiment of the invention, the inner and outer deflector cones 202 and 204 of the nozzle 52 are shaped to cause the powder to be deposited on the can lid 12 in an annular band 46 (FIG. 3). It is contemplated that the inner and outer deflector cones 202 and 204 of the nozzle 52 could have a different configuration so that the powder is deposited on the surface 192 of can lid 12 in a different pattern. By properly shaping the flow path 200 along which the powder flows through the nozzle 52, almost any desired pattern of powder deposition can be obtained on the major side surface 192 of the can lid 12. Moreover, if desired, the entire surface 192 of the can lid 12, or the entire interior of a container, could be coated with powder from an appropriately designed spray nozzle.

Excess Powder Collector

The excess powder collector 142 partially encloses and is supported by nozzle 52. Excess powder collector 142 draws a flow Of excess powder which does not adhere to can lid 12 away from the can lid (FIG. 3) and back toward the outer periphery of nozzle 52. The reverse or backflow of oversprayed powder is drawn into a generally conical cavity 218 which is disposed inside a collector housing 220 and extends around the nozzle 52. The flow of excess powder away from can lid 12 into cavity 218 prevents powder from entering the atmosphere around the work station 16.

The collector housing 220 is maintained in a spaced apart relationship with respect to can lid 12 during movement of the can lid 12 to and from work station 16 and during spraying of can lid 12. The space between the collector housing 220 and the surface 192 of the can lid 12 at the work station 16 is approximately the same as the spacing between the nozzle 52 and the surface 192 of the can lid 12, that is, approximately ⅛ to 3/16 of an inch. Since the excess powder collector housing 220 is mounted on the nozzle 52, operation of the adjustment assembly 96 positions the excess powder collector 142 relative to can lid 12 at the same time as the nozzle 52 is positioned relative to can lid 12. By having both the collector housing 220 and the nozzle 52 spaced from the can lid 12 at all times, the conveyor 14 (FIGS. 1 and 2) can quickly move the can lid 12 to and from the work station 16.

Collector housing 220 is supported on outer deflector cone 204 of nozzle 52. A conical outer side surface 224 on deflector cone 204 cooperates with a conical inner side surface 226 on collector housing 142 to form the generally conical chamber 218 in which excess powder is collected. The chamber 218 has a generally annular cross sectional configuration in a plane which extends perpendicular to the longitudinal central axis of spray gun 18.

A continuously operated venturi-type fluid amplifier 230 (FIG. 2) is mounted on the collector container 92 and is connected in fluid communication with excess powder chamber 218 by a conduit 234. Amplifier 230, later described, provides a pumping action which continuously reduces the fluid pressure in the conduit 234 and draws oversprayed powder away from the surface 192 (FIG. 3) of the can lid 12 into the chamber 218. This flow of powder is conducted through an outlet 232 from chamber 218 to conduit 234 (FIG. 2) leading away from excess powder collector 142 and into powder collector container 92. Since amplifier 230 is continuously operating, it produces a continuous flow of air away from the work station 16. Therefore, any oversprayed powder produced at work station 16 at any time is drawn into chamber 218 and transported to collector 92.

Diverter Assembly

Figure 4:
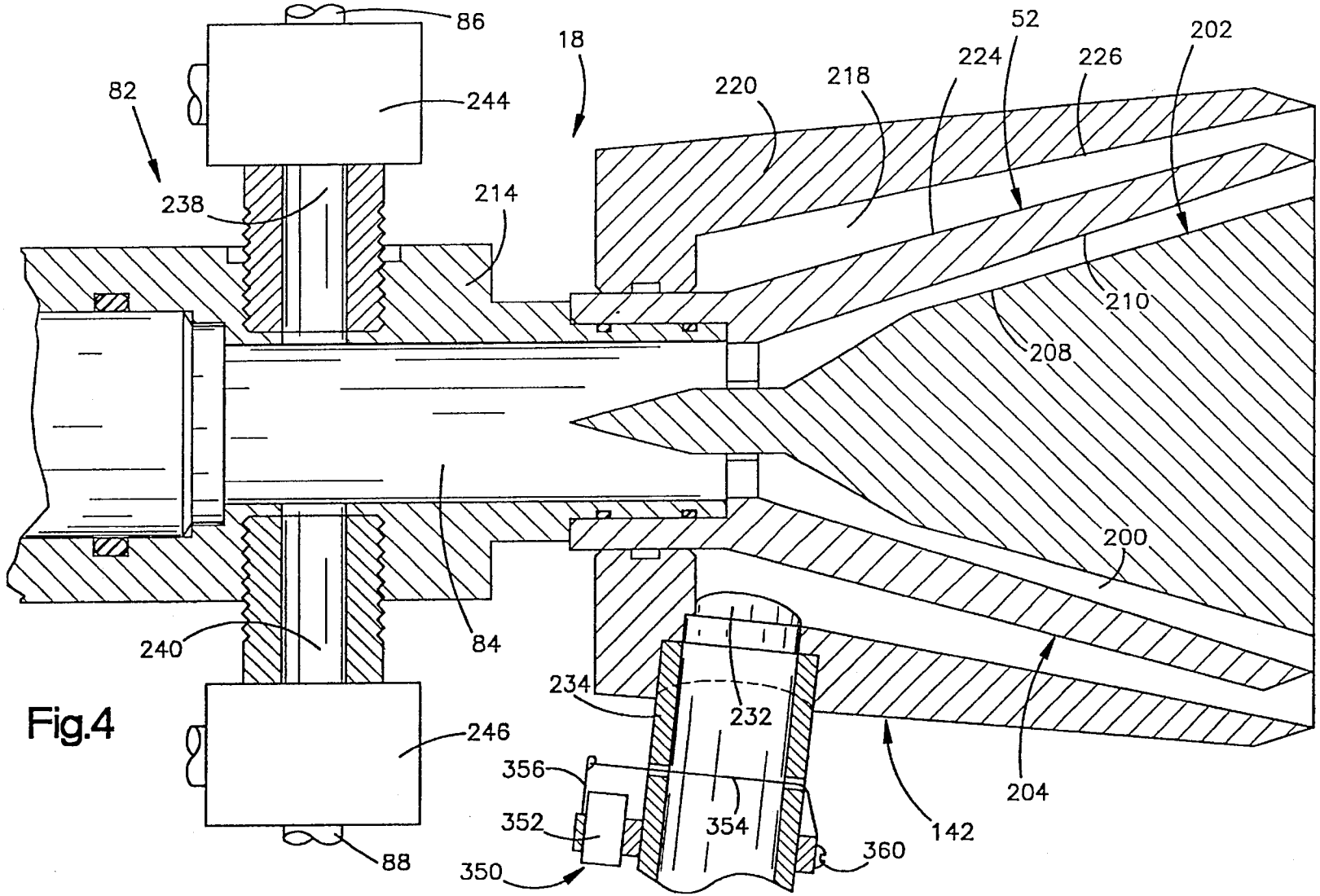
FIG. 4 is an enlarged sectional view of a portion of the powder spray gun and illustrating the relationship of a diverter assembly and fire detection apparatus to the nozzle of the powder spray gun.

The diverter assembly 82 (FIGS. 2 and 4) periodically diverts powder flowing through spray gun 18 away from the nozzle 52. The diverter assembly 82 is normally in an active condition directing air or powder flow in gun 18 away from the nozzle 82 through passages 238 and 240 (FIG. 4) leading to the conduits 86 and 88 (FIG. 2). When powder is to be sprayed from the nozzle 52 onto a lid 12, the diverter assembly 82 is changed to an inactive condition in which it does not divert powder flowing through the gun away from nozzle 52 but instead allows it to pass into and through nozzle 52. Then when the flow of powder from the nozzle 52 is to be interrupted again, diverter assembly 82 is changed back to the active condition in which powder flow from the main passage 84 of gun 18 is diverted into passages 238 and 240 (FIG. 4).

The diverter assembly 82 includes a pair of air amplifiers 244 and 246 which induce a flow of air and powder from the main passage 84 to the diverter conduits 86 and 88 when the diverter assembly is in its normal active condition. The flow of air and powder from the main passage 84 through the amplifiers 244 and 246 is conducted by the conduits 86 and 88 to the hopper 168 of the powder collector 92. When the diverter assembly 82 is in an inactive condition, the amplifiers 244 and 246 are turned off and are therefore ineffective to induce a flow of air and powder from the main passage 84.

Figure 5:
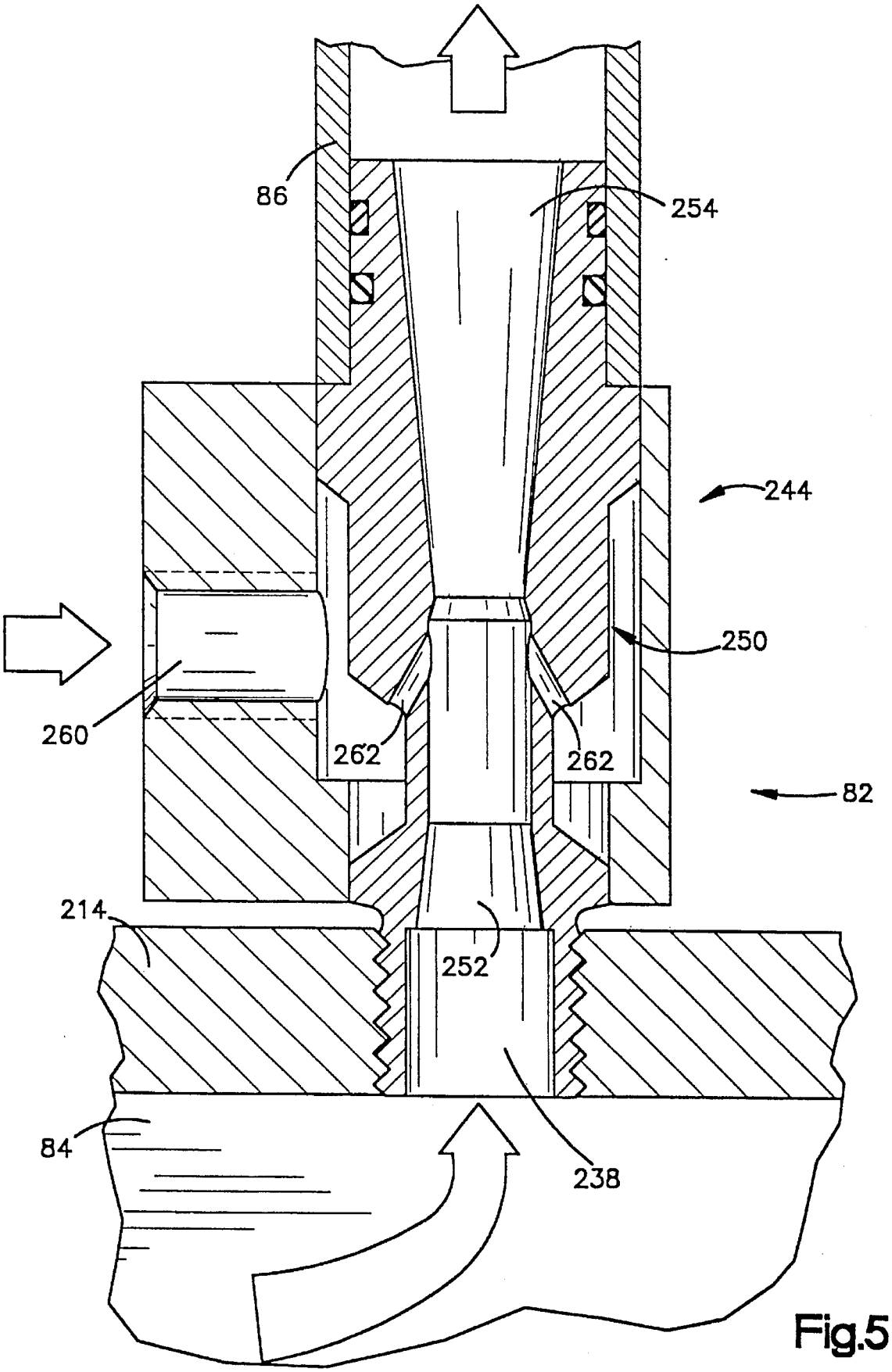
FIG. 5 is an enlarged sectional view of an amplifier which promotes a flow of air with powder entrained therein away from the diverter assembly.

Air amplifier 244 is illustrated in FIG. 5. Amplifier 244 includes a venturi-type nozzle 250 having an inlet 252 which is connected in fluid communication with main passage 84 through diverter passage 238. The venturi-type nozzle 250 has an outlet 254 which is connected in fluid communication with the conduit 86.

To induce a flow of air with powder entrained therein from the main passage 84 through the amplifier 244 to the conduit 86, a solenoid valve 258 (FIG. 2) is actuated to an open condition to direct a flow of air under pressure to an inlet 260 (FIG. 5) to the amplifier. The air flows from the inlet 260 through passages 262 at the throat of the nozzle 250. The flow of air into nozzle 250 through the passages 262 draws air with powder entrained therein, from the main passage 84 through diverter passage 238 to the conduit 86. The rate of flow of air with powder entrained therein, from the outlet 254 of the nozzle 250, is a substantial amplification of the rate of flow of air through the inlet 260 of the amplifier 244. This results in a pumping action which draws the flow of air with powder entrained therein from the main passage 84 through the amplifier 244.

The diverter assembly 82 includes a second amplifier 246 (FIG. 2) having the same construction as the amplifier 244. The amplifier 246 is effective to induce a flow of air with powder entrained therein through diverter passage 240 from a side of the main passage 84 opposite to the amplifier 244. The combined effect of the two amplifiers 244 and 246 is to induce the entire flow of air with powder entrained therein to leave the main passage 84 and flow through the diverter assembly 82 to the conduits 86 and 88, so that flow towards spray nozzle 52 is cut off. A second solenoid 264 is provided to control the flow of air to the amplifier 246.

Although the amplifier 244 has been described in connection with the diverter assembly 82, it should be understood that the amplifier 230 which induces a flow of air and powder from the excess powder collector 142 has the same general construction and mode of operation as the amplifiers 244 and 246. However, the amplifier 230 which draws the excess powder from the chamber 218 (FIG. 4), is somewhat larger than the amplifiers 244 and 246 and has a greater flow capacity. Likewise, the other amplifiers which form a part of this powder coating system, such as amplifier 62, are also of the same general configuration as is shown in FIG. 5.

Bulk Powder Container

Figure 6:
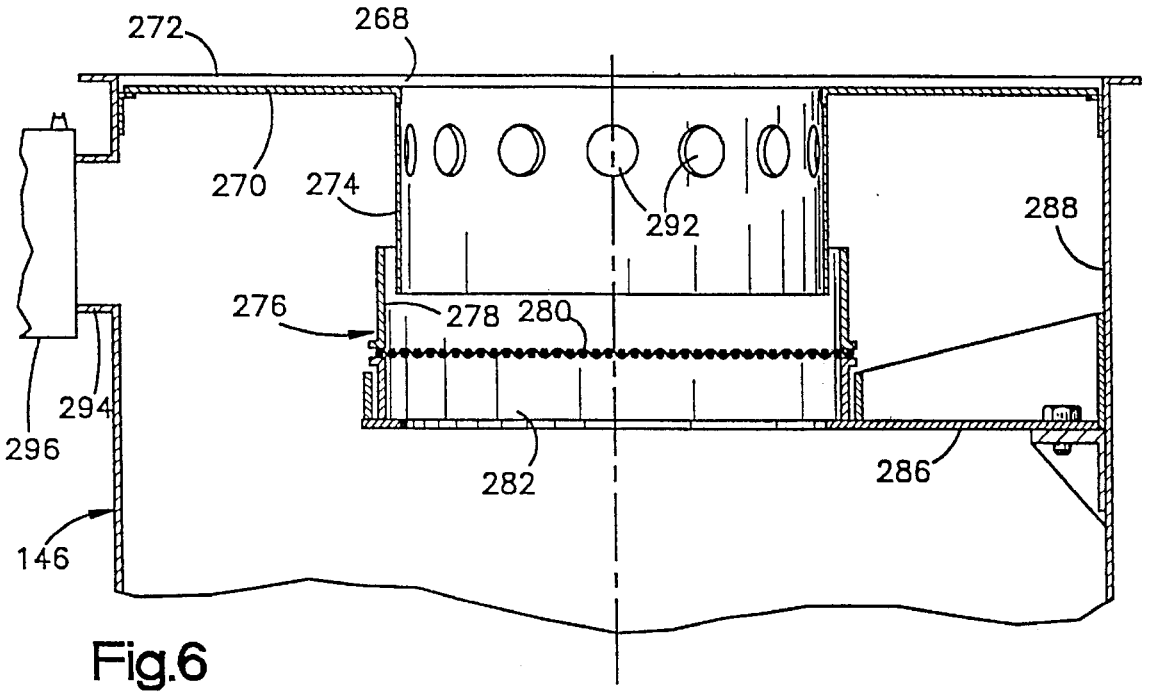
FIG. 6 is an enlarged fragmentary sectional view of an upper end portion of a bulk powder container which forms part of the powder supply system.

As mentioned above, collector 92 (FIG. 2) is supplied with virgin powder from bulk powder container 146 as needed. When the bulk powder container 146 is to be filled with virgin powder, a cover 266 (FIG. 1) is removed from bulk container 146. This opens a circular upper end portion 268 (FIG. 6) of bulk container 146.

A horizontal annular side wall 270 extends inwardly from a rim 272 (FIG. 6) of the opening 268. Annular side plate is connected to a vertically downwardly extending cylindrical wall 274. A sieve or screen assembly 276 is disposed in axial alignment with the downwardly extending wall 274. The sieve or screen assembly 276 includes an upwardly extending cylindrical wall 278 which telescopically overlaps the downwardly extending wall 274. A screen 280 extends across the inner wall 278.

To fill bulk powder container 146 with virgin powder, the powder is poured from a bag or box into the open upper end of the cylindrical wall 274. The powder flows downwardly onto the screen 280. Some powder flows through screen 280 and some rests on screen 280 until the vibrator 158 is operated to vibrate the bulk powder container 146. Upon operation of the vibrator 158, the virgin powder is vibrated through the screen 280 and falls downwardly through a circular open lower end portion 282 of screen assembly 276 into bulk powder container 146. As the powder falls through the screen 280, it is aerated and otherwise conditioned for use by the powder spray gun 18.

Screen assembly 276 (FIG. 6) is mounted on a cantilevered arm 286. Arm 286 extends inwardly from a cylindrical side wall 288 of bulk container 146. As previously described, vibrator 158 vibrates container 146. The cantilevered mounting arrangement for screen assembly 276 allows the screen 280 to vibrate with container 146 during operation of the vibrator 158. In fact, the cantilever support design amplifies the vibration of screen 280 relative to the container 146 as the container vibrates which enhances breaking up of the powder so that it can fall through the screen into the conical bottom portion of container 146. If desired, a switch could be provided at the bulk powder container 146 to enable an operator to initiate operation of the vibrator 158 as the container is filled.

As the powder falls downwardly through the cylindrical wall 274 (FIG. 6) toward screen assembly 276, it is contemplated that dust will be generated. This dust, or powder drifting in the air, is drawn radially outwardly through circular openings 292 formed in the side wall 274. The flow of air and dust through the openings 292 is conducted to an outlet 294 by an air amplifier 296 which is provided to induce a flow of air and powder through the opening 294 to a conduit 298 (FIG. 2). Conduit 298 is in turn connected to an inlet 300 to hopper 168 in the powder collector 92. Amplifier 296 is of the same design as is shown in FIG. 5.

During operation of the apparatus 10, virgin powder will be supplied from the bulk powder container 146 to the powder collector container 92 through the pump 162 and conduit 160. When the quantity of powder in the bulk powder container 146 has been decreased to less than a predetermined amount, the sensor 154 will provide an appropriate output signal. The output signal from the sensor 154 triggers a visual and/or audible alarm to an operator indicating that the bulk powder container 146 should be refilled. The sensor 154 is positioned opposite a transparent plastic window (not shown) provided in the side wall of hopper 146 to read the level of powder in hopper 146. Sensor 154, in the presently preferred embodiment, is a capacitive proximity switch which is commercially available under the designation KGE-2008-FBOA from Efector, Inc., a subsidiary of IFM Electronic and having a place of business in Exton, Pa. Of course, other types of particulate matter level sensors could be used if desired.

Powder Collector Container

The powder collector container 92 (FIG. 2) functions as a central receiving location from which powder is transported to the powder spray gun 18 and to which powder is diverted from the powder spray gun and from excess powder collector 142. Powder collector container 92 includes a relatively large housing 302 which encloses the hopper 168 and fan assembly 182. Housing 302 has an inlet 304 which is connected to conduit 160 from bulk container 146. Whenever sensor 152 detects that the quantity of powder in the hopper 168 is less than a predetermined quantity, sensor 152 produces an appropriate output signal to controller 30 and pump 162 is turned on to transport air with virgin powder entrained therein through the conduit 160 to the inlet 304. Sensor 152 is identical to sensor 154, and like sensor 154, senses the level of powder in hopper 168 through a transparent window (not shown) which is provided in the side wall of hopper 68.

During spraying of workpieces 12 at the work station 16, excess powder is conducted from the excess powder collector 142 through the conduit 234 and amplifier 230 to a second inlet 306 to powder collector 92. Powder is also diverted into collection hopper 168 through inlet 300 from screen assembly 276, and through the inlets for diverter conduits 86 and 88 as previously described, and also through an inlet for conduit 337 from feed hopper 56 which will be described later on. Having delivered the powder into hopper 168 from these various sources, it is necessary to separate the powder from the transport air. Cartridge filters 180 in collector 92 serve to fulfill this function.

The interiors of filter cartridges 180 are connected in fluid communication with the fan assembly 182 through openings 310 formed in the wall of the hopper 168 and a wall of the housing 302 separating the hopper 168 from the fan chamber 184 as previously mentioned. The fan assembly 182 continuously induces a flow of air through filter cartridges 180. This flow of air results in the powder being deposited on the outside of the filter cartridges 180 as the cleaned air flows into the interior of the cartridges. This cleaned air is then drawn from the interior of cartridges 180 through openings 310 and into fan chamber 184 by fan 182 and is then exhausted through final filter 186 to the atmosphere around the apparatus 10.

To prevent cartridge filters 180 from clogging, high pressure pulses of air are intermittently directed into the filters to highly pressurize the inside of filter 180 and thereby blow the powder off of the outside of the filters. To accomplish this, a solenoid valve 312 (FIG. 2) is periodically actuated to direct a flow of air through a conduit 314. The conduit 314 is axially aligned with the opening 310 and the longitudinal axis of one of the filter cartridges 180. A second conduit and solenoid valve (not shown), corresponding to the conduit 314 and solenoid valve 312, are provided to permit pulse cleaning of the second filter cartridge. The axial flow of air into the filter cartridges 180 blows the powder off of the outside of the cartridges 180 so that the powder can fall downwardly into the hopper 168 for transport through pump 174 to feed hopper 56.

Powder is conducted from the hopper 168 (FIG. 2) to the feed powder container 56 through the conduit 176. To establish a flow of powder through the conduit 176, pneumatically actuated pinch valve 172 is opened. With valve 172 open, powder pump 174 pumps a flow of air with powder entrained therein through the conduit 176 to the powder feed container 56. The venturi-type powder pump 174 is always operating as mentioned above. Therefore, when the pinch valve 172 is closed, the pump 174 is effective to maintain a constant fluid pressure on the powder in the powder feed container 56. Pinch valve 172 and pump 174 are connected to the hopper 168 and are vibrated with the hopper by the vibrator 166. Vibrator 166 is operated whenever pinch valve 172 is open.

The housing 302 of the powder collector container 92 has an open upwardly extending hood 318 (FIG. 1). A rectangular opening 320 is formed in the side of the hood 318 which faces toward the powder spray gun 18. The fan assembly 182 is effective to induce a continuous flow of air through the opening 320 into the powder collector container 92.

In the unlikely event of a fire in collector 92, pressure can escape from the powder collector container 92 through the opening 320 in the hood 318. This prevents a potentially explosive build up of pressure within the powder collector container 92.

Powder Feed Container

A generally cylindrical powder feed container 56 (FIG. 2) is mounted above the powder pump 54 of the spray gun 18. During operation of the spray gun 18, powder is drawn from the powder feed container 56 by the powder feed pump 54. Powder feed container 56 is supplied with powder from powder collector 92.

Figure 7:
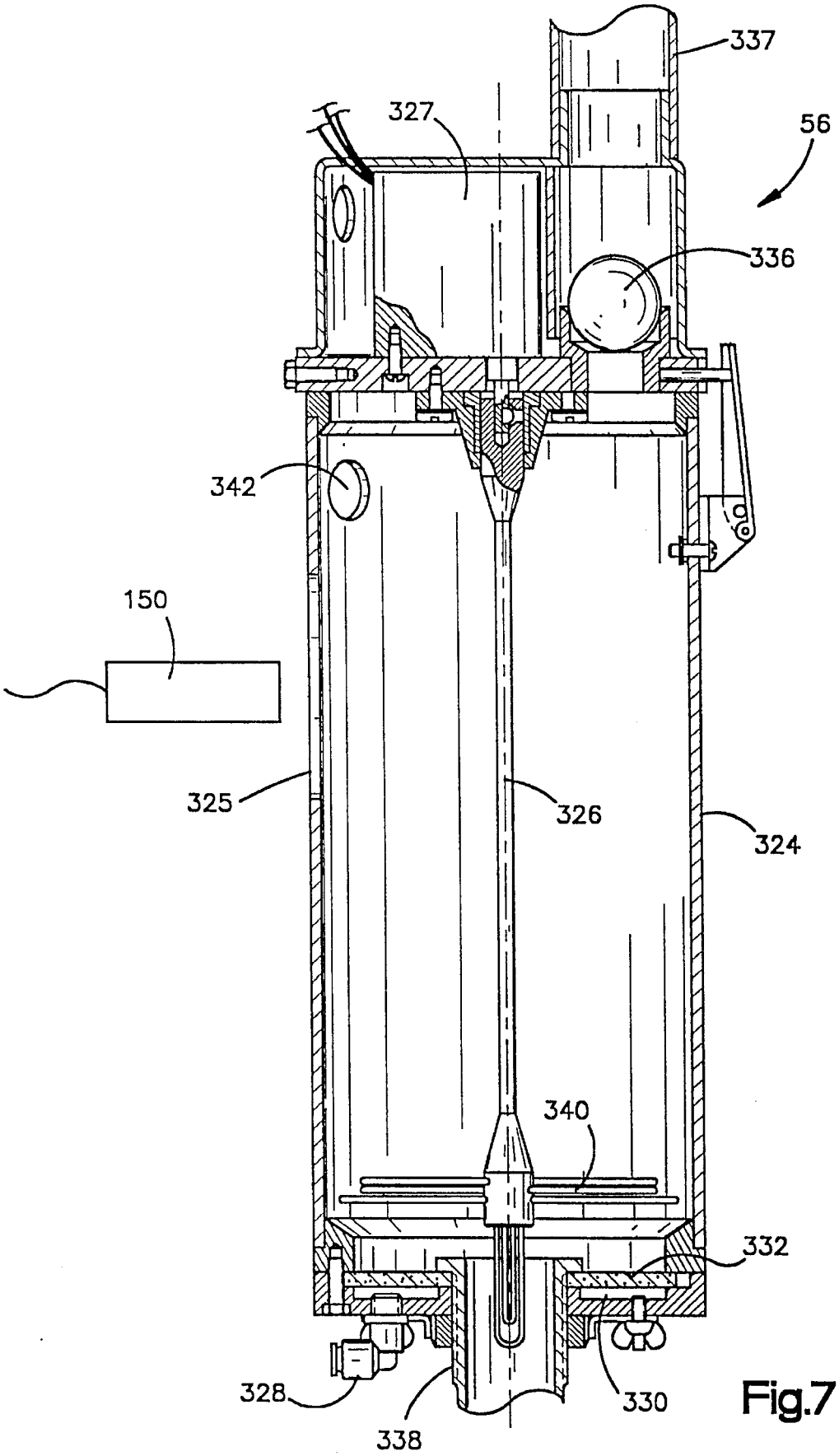
FIG. 7 is a sectional view of a powder feed container which is mounted at the rear of the powder spray gun.

The powder feed container 56 includes a cylindrical housing 324. A stirrer 326 (FIG. 7) is disposed along the vertical central axis of the housing 324 and includes four radially disposed arms 340. The stirrer 326 is slowly rotated, at approximately one revolution per minute, by a motor 327. The stirrer 326 gently disturbs or agitates the powder to promote fluidization and flow of the powder from the container 324 into the powder pump 54.

Fluidization of the powder in the container 324 is also promoted by a flow of air through a fitting 328 (FIG. 7) into an annular chamber 330 disposed beneath a porous plate 332. The air flows upwardly from the chamber 330 through the plate 332 and the powder in the housing 324. The air, with some powder entrained therein, is exhausted from the housing through a gravity type check valve 336 whenever the pressure in container 324 is enough to unseat check valve 336. This air and powder is conducted from container 336 to the hopper 168 in the powder collector container 92 through a conduit 337.

The upward flow of fluidizing air through the powder in the housing 324 and the stirrer 326 maintain the powder in a loose and fluidized condition. This facilitates uniform flow of powder into the powder pump 54.

The sensor 150 (FIG. 2), which is identical to sensors 152 and 154, senses the quantity of powder in the container 324 through a transparent window 325 provided in the side wall of container 324 and, when less than a predetermined level of powder is present, provides an appropriate output signal to controller 30. The output signal from the sensor 150 initiates the opening of pinch valve 172 and activation of vibrator 166 to transport powder from the powder collector container 92 through the conduit 176 to the powder feed container 56. The flow of powder from the conduit 176 enters the housing 324 (FIG. 7) tangentially through an opening 342. By having a tangential flow of powder into the housing 324 through the opening 342, a swirling effect is obtained which promotes fluidization of the powder. This swirling effect is also produced when no powder is entering housing 324 since even when pinch valve 172 is closed compressed air is being transported through opening 342 by pump 174 which is continuously operating to maintain relatively constant pressure conditions inside hopper 56 whether or not powder is then being transported into the hopper. By maintaining a constant pressure condition and a controlled powder level in hopper 56, powder flow through pump 54 is made uniform from pulse to pulse. The pressure conditions in hopper 56 also determine how much powder is entrained in each pulse of powder discharged from pump 54, with higher pressure conditions resulting in more powder being entrained in each pulse.

Fire Protection

It is contemplated that, due to the fact that the powder is electrostatically charged, a fire could occur between the nozzle 52 and can lid 12. A fire detection apparatus 350 (FIG. 4) is provided to detect the occurrence of such a fire. Upon the occurrence of a fire between the nozzle 52 and a can lid 12, the fire will be drawn into the excess powder collector cavity 218 due to the negative pressure condition therein. From there, the fire will be drawn into conduit 234 leading to the collector container 92. A filament or line 354 extends across conduit 234 from an arm 356 of a switch assembly 352 to a fixed connection 360 on a side of the conduit 234 opposite from switch assembly 352. The filament or line 354 is formed of material which fuses or burns upon even a relatively brief exposure to flame or heat. Although the filament 354 could have many different constructions, it is presently preferred to form the filament with a relatively rigid polyester core surrounded by a jacket of nylon. The manner in which the filament 354 is constructed and cooperates with the switch 352 is the same as is disclosed in U.S. Pat. No. 4,675,203 which is hereby incorporated herein, in its entirety, by this reference thereto.

Upon the occurrence of a fire between the nozzle 52 and can lid 12, the fire will be drawn through excess powder collector 142 to conduit 234. Upon entering conduit 234, the fire will burn through filament 354 releasing the spring biased arm 356 of the switch assembly 352. When the arm 356 is released, contacts in the switch assembly 352 provide an output signal to the controller 30. Upon receiving a signal from the switch assembly 352, the controller 30 completely shuts down the apparatus 10 which cuts off further powder flow through the gun and prevents the fire from being drawn into collector 92 so that the fire extinguishes itself for lack of additional fuel. Although one specific fire detection apparatus 350 has been illustrated, it should be understood that other known fire detection apparatus could be utilized if desired.

Operation

When operation of the apparatus 10 is to be initiated, the spray gun 18 and excess powder collector 142 are accurately positioned relative to the can lid 12 at work station 16 and turret 38. This is accomplished by operating the three-axis adjustment assembly 96 (FIG. 2) to first move the X axis slide 112, spray gun nozzle 52 and excess powder collector 142 along an axis which is coincident with the longitudinal central axis of the spray gun (X axis). The nozzle 52 and excess powder collector 142 are then positioned sidewardly relative to a can lid 12 at work station 16 by moving the Y axis slide 98 relative to the base 104. The nozzle 52 and excess powder collector 142 are then positioned vertically relative to the work station 16 by moving the Z axis slide 128. Several can lids, or other workpieces, can be positioned in this way and then coated to find the optimal position of spray gun 18 relative to can lid 12. The X, Y and Z indicias can then be recorded to ensure that this position is maintained.

The powder supply system is then checked to be certain that powder supply containers 56, 92 and 146 contain the proper amount of powder. If they do not, they are filled to the desired levels. The supply of can lids in the holder 36 is then checked to ensure that it is adequate. Operation of the conveyor assembly can now be initiated so that turret 38 rotates to index a first can lid 12 to the work station 16.

As the first can lid 12 moves to the work station 16, the solenoid valves 58 and 64 (FIG. 2) are opened to provide a flow of compressed air through the powder pump 54 and amplifier 64, respectively. This pumps powder from feed hopper 56 through pump 54 and amplifier 64 into diffuser 70, and through diffuser 70 to the electrostatic charging unit 76. Solenoid 72 of diffuser 70 is always open during operation of the system to provide continuous air flow through diffuser 70 to purge the gun between pulses as is explained in U.S. Pat. No. 4,987,001 which has been incorporated by reference. By purging the gun between pulses, the air from diffuser 70 flows up into feed container 56 to keep powder from container 56 from falling into pump 54 when pump 54 is not being operated.

At this time, the diverter assembly 82 is in the active condition. That is, solenoid valves 258 and 264 are open so that compressed air is passing through amplifiers 244 and 246. Shortly after solenoids 58 and 64 are energized, however, perhaps 10 milliseconds which is estimated to be the amount of time it takes for the front of the powder pulse to travel down spray gun 18 from pump 54 to diverter assembly 82, solenoids 258 and 264 are de-energized to allow the powder pulse to pass through the passage 84 of spray gun 12 to the nozzle 52.

As the stream 206 of air with powder entrained therein enters the nozzle 52, the stream has a solid circular cross sectional configuration. The inner deflector cone 202 (FIG. 3) opens the central portion of the stream 206. This results in the stream 206 having an annular cross sectional area as viewed in a plane extending perpendicular to the longitudinal central axis of the spray gun 18.

As the flow of powder continues through the annular powder flow channel 200 in the nozzle 52, the stream 206 of powder is expanded radially outwardly. Radial expansion of the stream 206 continues until the cross sectional size and configuration of the stream corresponds to the desired configuration of the annular band 46 (FIG. 3) of powder to be deposited on the surface 192 of can lid 12. Due to the electrostatic charge which has been applied to the powder, a layer of the powder adheres to the can lid 12 to form an annular band 46 of powder. This adhering of the powder occurs even when the lid 12 is electrically insulated, such as by mounting it on a plastic vacuum chuck 42, in that the lid will still have a different electrical potential than the charged powder.

As a coating of powder is being applied in an annular band to the can lid 12, excess powder which does not adhere to the can lid, is drawn into the chamber 218 in the excess powder collector 142. The excess powder is drawn from the chamber 218 and through the conduit 234 by the continuously operated amplifier 230.

After the solenoid valves 58 and 64 (FIG. 2) have been on for approximately 80 milliseconds, for this application, they are turned off to interrupt the pumping of powder from feed hopper 56. Approximately 20 milliseconds thereafter, solenoids 258, 264 for amplifiers 244, 246 in the diverter assembly are activated to divert the flow of powder away from the nozzle 52 by drawing air with powder entrained therein from the main passage 84 through the conduits 86 and 88 to collector 92. This diverted powder comprises the "tail" of the powder pulse, and by cutting the tail of the pulse off, the pulse of powder coating material sprayed toward lid 12 is cleanly cut off. The turret 38 is then rotated to move the just coated can lid 12 from the work station 16 and to move the next succeeding can lid 12 to work station 16.

In the illustrated embodiment of the invention, it is preferred to establish an intermittent flow of air and powder from the powder spray gun 18 by interrupting the flow of air and powder through the pump 54 (FIG. 2) connected to the powder feed container 56. However, if desired, the pump 54 could be continuously operated. If this was done, there would be a continuous flow of air through the solenoid control valve 58 and a continuous flow of air and powder through the pump 54. The diverter assembly 82 would be operated to interrupt the flow of air and powder to the nozzle 52 during movement of a can lid 12 to and from the work station 16. The diverter assembly 82 would be rendered inactive only when a can lid at the work station 16 is to be sprayed with powder.

Can lids are processed at a rate of approximately three hundred per minute. This high speed operation is obtainable because powder spray gun 18 does not interact with (i.e., contact) the can lid other than to direct a flow of powder onto the can lid. Thus, the nozzle 52 and excess powder collector 142 remain spaced apart from the can lids 12 during movement of the can lids to and from the work station 16 and during spraying of powder onto the can lids at the work station. If it is necessary to disassemble the powder spray gun 18 for cleaning or routine maintenance, the indicia associated with the slides 98, 112 and 128 upon which the spray gun is mounted enables the spray gun to be quickly and easily returned to its original position relative to the work station 16.

During operation of the powder spray gun 18, the quantity of powder in the powder feed container 56 is decreased. When the quantity of powder in the powder feed container 56 falls below a predetermined level, the sensor 150 provides an appropriate output signal to controller 30 which initiates operation of the pinch valve 172 (FIG. 2) from a closed condition to an open condition. Opening of the pinch valve 172 enables powder to flow from the hopper 168 in collector 92 through the continuously operating pump 174 to the powder feed container 56. Simultaneously with opening of the pinch valve 172, the vibrator 166 is operated to vibrate the hopper 168, pinch valve 172 and pump 174 to promote the even flow of powder to the feed container 56.

If the level of powder in the hopper 168 of the powder collector container 92 falls below a predetermined level, the sensor 152 provides an appropriate output signal to controller 30 which initiates operation of the powder feed pump 162 to feed powder from the bulk powder container 146 to collector 92. Simultaneously with initiation of operation of the powder feed pump 162, the vibrator 158 is activated. Operation of the vibrator 158 vibrates the bulk powder container 146 and the powder feed pump 162 to promote the even flow of virgin powder from bulk container 146 to collector hopper 168.

The cartridge filters 180 disposed in the hopper 168 of the powder collector container 192 remove the powder from the air. Blasts of compressed air are periodically directed into the cartridges 180 to dislodge any powder which accumulates on the exterior thereof. A fan assembly 182 promotes a continuous flow of cleaned air through the filters 180 and through the final filter 186 into the atmosphere around the apparatus 10.

During continued operation of the powder spray gun 18, the level of powder in the bulk powder container 146 may fall below a predetermined level. When this occurs, the sensor 154 provides an appropriate output signal to controller 30 which in turn initiates operation of an alarm to notify the operator of the powder spray gun 18 that additional powder is required in the bulk powder container 146.

Spraying Can Bodies

Figure 8:
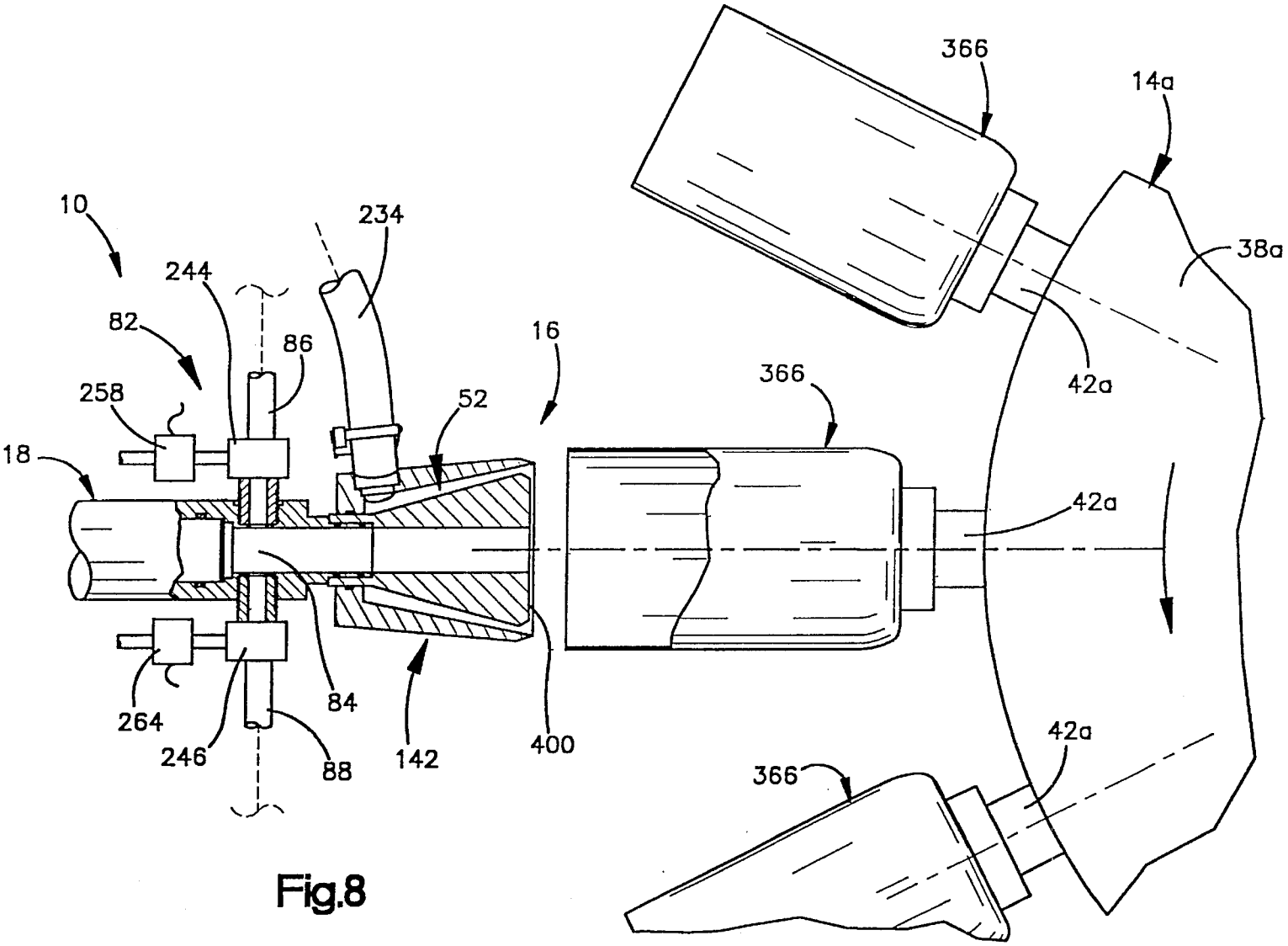
FIG. 8 is a fragmentary schematic sectional view, generally similar to a portion of FIG. 2, illustrating the manner in which the apparatus is used to apply powder to can bodies.

The foregoing description of the method of operation of the apparatus 10 has been in conjunction with the spraying of annular bands 46 of powder onto can lids 12. However, it is contemplated that the apparatus 10 could be utilized to spray powder on many different articles, including can bodies. Use of the apparatus 10 to spray the interior of can bodies 366 is illustrated schematically in FIG. 8. One end of a cylindrical can body 366 is closed by an end wall and is engaged by one of the chucks 42*a*. The opposite end of the can body 366 is open and faces toward the spray gun 18.

As the turret 38 indexes, each can body 366 is moved in turn from a pickup station (not shown) to the work station 16. As each can body 366 is moved to the work station 16, rotation of the turret 38 is momentarily interrupted. A central axis of the cylindrical can body 366 is coincident with a central axis of the spray gun 18 and nozzle 52 when the can body is at the work station 16.

The spray gun 18 is then operated to spray powder into the open, outwardly facing end of the can body 366. Powder is applied into the can body through a nozzle 400 having a single central opening. The pulse of powder sprayed through nozzle 400 first impacts the bottom of the can and is then drawn by excess powder collector 142 back along the walls of the can so that both the bottom and side walls of the can are coated. Any excess powder which does not adhere to the can is drawn into excess powder collector 142 and returned to collector 92. The system operates in the identical manner to that described above for the coating of can lids.

Having described the structure and operation of apparatus for both can lid coating and can interior coating, it should now also be appreciated that the invention also encompasses various novel methods.

One such method involves the use of an X–Y–Z positioning apparatus to accurately position the spray gun relative to the container or closure being coated.

Another involves the application of an annular spray pattern to can ends to coat a score line thereon.

Still another involves the spraying of powder down into the middle of a can to impact the bottom and then causing it to return along the sides of the can for complete coverage of the can.

Yet another involves the use of a diverter within the gun to divert the tail of the pulse of powder sprayed through the gun so that a sharply defined pulse of powder is applied to the workpiece.

While preferred embodiments of the invention have been described, it is evident that many other alternatives, modifications and variations will be apparent to those skilled in the art in light of the foregoing description. Accordingly, the invention is intended to embrace all such alternatives, modifications and variations as fall within the spirit and scope of the appended claims.

Having described the invention, the following is claimed:

1. A method of sequentially applying powder to each article of a plurality of articles, said method comprising the steps of sequentially forming a series of pulses of air with powder entrained therein, sequentially conducting each of the pulses of air with powder entrained therein along a flow path through a spray gun toward a work station where powder is applied to each of the articles in turn, and sequentially diverting a portion of each of the pulses of air with powder entrained therein from the flow path through the spray gun to sharply define an edge portion of each of the pulses of air with powder entrained therein.

2. A method as set forth in claim 1 wherein said step of sequentially diverting a portion of each of the pulses of air with powder entrained therein from the flow path includes diverting a trailing end portion of each of the pulses of air with powder entrained therein from the flow path.

3. A method as set forth in claim 1 further including the step of electrostatically charging the powder in each of the pulses of air with powder entrained therein in turn during sequential movement of each of the pulses of air with powder entrained therein along the flow path through the spray gun, said step of diverting a portion of each of the pulses of air with powder entrained therein from the flow path being performed after performing said step of electrostatically charging the powder in each of the pulses of air with powder entrained therein.

4. A method as set forth in claim 1 further including the steps of conducting a flow of air with excess powder entrained therein away from the work station.

5. A method as set forth in claim 4 further including the steps of providing a fusible element in the path of flow of air with excess powder entrained therein away from the work station and providing an output signal in response to the fusible element being fused by exposure to heat in the path of flow of air with excess powder entrained therein.

6. A method as set forth in claim 1 wherein said step of sequentially forming a series of pulses of air with powder entrained therein includes operating a pump to induce a flow of air with powder entrained therein along the flow path through the spray gun and repeatedly interrupting operation of the pump, said step of diverting a portion of each of the pulses of air with powder entrained therein being performed contemporaneously with interrupting operation of the pump.

7. A method of comprising the steps of sequentially moving a plurality of can lids to and from a work station, and spraying an annular band of powder onto a major side surface of each of the can lids in turn at the work station, said step of spraying an annular band of powder onto a surface of each of the can lids in turn includes maintaining a nozzle in a spaced apart relationship with each of the can lids while conducting a flow of air with powder entrained therein from the nozzle toward the major side surface of each of the can lids along a flow path which has an annular cross sectional configuration in a plane which extends perpendicular to a central axis of the flow path, maintaining a space circumscribed by the flow path substantially free of powder, and, while continuing to maintain the nozzle in a spaced apart relationship with the can lids, depositing the powder on the major side surface of each of the can lids in turn in an annular band which circumscribes an area on the major side surface of the can lid which is substantially free of powder.

8. A method as set forth in claim 7 further including the steps of diverting a flow of air with powder entrained away from the nozzle upon completion of spraying of an annular band of powder onto each of the can lids in turn.

9. A method comprising the steps of sequentially moving a plurality of articles to and from a work station and spraying powder onto a surface of each of the articles in turn at the work station, said step of spraying powder onto a surface of each of the articles in turn includes operating a pump to induce a flow of air with powder entrained therein toward a nozzle along a flow path extending between the pump and the nozzle, interrupting operation of the pump to interrupt the flow of powder along the flow path between the pump and the nozzle, and, contemporaneously with performance of said step of interrupting operation of the pump, operating a diverter from an inactive condition in which the diverter is ineffective to effect the flow of air with powder entrained therein toward the nozzle to an active condition in which the diverter is effective to induce a flow of air with powder entrained therein from the flow path extending between the pump and the nozzle, said step of sequentially moving articles to and from a work station includes initiating movement of each of the articles in turn away from the work station while the diverter is in the active condition.

10. A method as set forth in claim 9 further including the step of electrostatically charging the powder in the flow of air with powder entrained therein, said step of operating a diverter from an inactive condition to an active condition includes inducing a flow of air with electrostatically charged particles of powder entrained therein away from the nozzle.

11. A method a set forth in claim 9 wherein said step of spraying powder onto a surface of each of the articles in turn includes maintaining the nozzle in a spaced apart relationship with each of the articles while conducting a flow of air with powder entrained therein from the nozzle toward the surface of each of the articles along a flow path which has an annular cross sectional configuration in a plane which extends perpendicular to a central axis of the flow path, maintaining a space circumscribed by the flow path substantially free of powder, and, while continuing to maintain the nozzle in a spaced apart relationship with the articles, depositing the powder on the surface of each of the articles in turn in an annular band which circumscribes an area on the surface of the article which is substantially free of powder.

12. A method of sequentially applying powder to each article of a plurality of articles, said method comprising the steps of sequentially forming pulses of air with powder entrained therein at a first location, conducting a flow of the pulses of air with powder entrained therein along a flow path which extends from the first location to a nozzle, electrostatically charging powder in each of the pulses of air with powder entrained therein during sequential flow of the pulses of air with powder entrained therein through a charging location disposed along the flow path between the first location and the nozzle, diverting a first portion of each of the pulses of air with powder entrained therein from the flow path at a location disposed along the flow path between the charging location and the nozzle, and sequentially directing a second portion of each of the pulses of air with powder entrained therein from the nozzle toward each of the articles in turn.

13. A method as set forth in claim 12 wherein said step of sequentially directing a second portion of each of the pulses of air with powder entrained therein from the nozzle toward each of the articles in turn includes maintaining the nozzle in a spaced apart relationship with each of the articles and sequentially shaping the second portion of each of the pulses of air with powder entrained therein to have an annular cross sectional configuration in a plane which extends perpendicular to a path of flow of the second portion of each of the pulses of air with powder entrained therein from the nozzle, said method further includes sequentially depositing the powder in the second portion of each of the pulses of air with powder entrained therein on the surface of each of the articles in an annular band which circumscribes an area on the surface of the article which is substantially free of powder.

14. A method as set forth in claim 12 further including the steps of conducting a flow of air with powder entrained therein away from the flow path of pulses of air with powder entrained therein, providing a fusible element in the path of flow of air with powder entrained therein away from the flow path of pulses of air with powder entrained therein, and providing an output signal in response to the fusible element being fused by exposure to heat.

15. A method comprising the steps of sequentially moving a plurality of can lids to and from a work station, and spraying an annular band of powder onto a major side surface of each of the can lids in turn at the work station, said step of spraying an annular band of powder onto a major side surface each of the can lids in turn includes conducting a flow of air with powder entrained therein from a nozzle toward the major side surface of each of the can lids in turn along a flow path which extends transverse to the major side surface of the can lid while maintaining the nozzle in a spaced apart relationship with the can lid, said step of conducting a flow of air with powder entrained therein toward a major side surface of each of the can lids in turn includes conducting a flow of air with powder entrained therein through a space between the nozzle and the major side surface of each of the can lids in turn along a flow path which has an annular cross sectional configuration in a plane which extends perpendicular to a central axis of the flow path, said step of conducting a flow of air with powder entrained therein along a flow path which has an annular cross sectional configuration includes maintaining a central space circumscribed by the flow of air with powder entrained therein substantially free of powder and maintaining the nozzle in a spaced apart relationship with a can lid toward which the flow of air with powder entrained therein is conducted, and depositing the powder in an annular band on the major side surface of each of the can lids in turn with the major side surface of the can lid extending from a location adjacent to an outer periphery of the annular band of powder across a space circumscribed by the annular band of powder.

16. A method as set forth in claim 15 further including the steps of electrostatically charging powder in the flow of air with powder entrained therein before the flow of air with powder entrained therein enters the nozzle, conducting the flow of air with electrostatically charged powder entrained therein to the nozzle during performance of said step of spraying an annular band of powder onto a major side surface of each of the can lids in turn, and diverting the flow of air with electrostatically charged powder entrained away from the nozzle upon completion of spraying of an annular band of powder onto the major side surface of each of the can lids in turn and after having performed said step of electrostatically charging powder in the flow of air with powder entrained therein.

17. A method as set forth in claim 15 wherein said step of spraying an annular band of powder onto the major side surface of each of the can lids in turn includes operating a pump to induce a flow of air with powder entrained therein toward the nozzle during the spraying of an annular band of powder onto the major side surface of one of the can lids, interrupting operation of the pump to interrupt the flow of powder toward the nozzle, and, contemporaneously with performance of said step of interrupting operation of the pump, operating a diverter from an inactive condition in which the diverter is ineffective to effect the flow of powder toward the nozzle to an active condition on which the diverter is effective to induce a flow of air with powder entrained therein away from the nozzle, said step of sequentially moving can lids to and from a work station includes initiating movement of the one can lid away from the work station while the diverter is in the active condition.

18. A method as set forth in claim 15 wherein said step of spraying an annular band of powder onto a major side surface of each of the can lids in turn includes producing a series of pulses of air with powder entrained therein, said step of conducting a flow of air with powder entrained therein from a nozzle toward a major side surface of each of the can lids in turn includes conducting a first portion of each of the pulses of air with powder entrained therein from the nozzle toward the major side surface of each of the can lids in turn and diverting a second portion of each of the pulses of air with powder entrained therein away from the nozzle before the second portion of each of the pulses of air with powder entrained therein can be conducted from the nozzle toward a can lid.

19. A method as set forth in claim 15 wherein said step of spraying an annular band of powder onto each of the can lids in turn includes conducting powder from a container to the nozzle, said method further including at least partially filling the container with powder, said step of at least partially filling the container with powder includes vibrating a sieve and conducting powder through the sieve while vibrating the sieve.

20. A method as set forth in claim 15 further including conducting a flow of air with excess powder entrained therein away from the major side surface of each of the can lids in turn at the work station to an excess powder collector while maintaining the excess powder collector in a spaced apart relationship with the major side surface of each of the can lids.

21. A method as set forth in claim 20 further including the steps of conducting a flow of air with excess powder entrained therein away from the excess powder collector to a receiving location, providing a fusible element in the flow of air with excess powder entrained therein and providing an output signal in response to the fusible element being fused by exposure to heat in the path of flow of air with excess powder entrained therein.

* * * * *